United States Patent [19]

Frohlich et al.

[11] Patent Number: 4,932,113

[45] Date of Patent: Jun. 12, 1990

[54] MANUFACTURE OF SLIDE FASTENERS

[75] Inventors: Alfons Frohlich, Essen; Werner Rademacher, Essen-Kettwig; Jorg Geiger, Oberhausen; Burghardt Neas, Essen; Wilhelm Wessling, Bocholt, all of Fed. Rep. of Germany

[73] Assignee: Opti Patent-, Forschungs- und Fabrikations-AG, Riedern-Allmeind, Switzerland

[21] Appl. No.: 387,294

[22] Filed: Jul. 28, 1989

[30] Foreign Application Priority Data

Jul. 28, 1988 [DE] Fed. Rep. of Germany ..... 3825712

[51] Int. Cl.[5] ..... B29D 5/00

[52] U.S. Cl. ..... 29/409; 29/33.2; 29/408; 29/766; 29/707; 29/712; 29/714

[58] Field of Search ..... 29/33.2, 408, 409, 766–768, 29/707, 712, 714, 717, 718

[56] References Cited

U.S. PATENT DOCUMENTS

| | | | |
|---|---|---|---|
| 2,885,774 | 5/1959 | Waldes | 29/408 |
| 3,118,219 | 1/1964 | Perrella | 29/408 |
| 3,570,104 | 3/1971 | Jensen | 29/408 |
| 4,625,375 | 12/1986 | Osaki | 29/766 |

FOREIGN PATENT DOCUMENTS

| | | | |
|---|---|---|---|
| 3712401 | 10/1988 | Fed. Rep. of Germany . | |
| 2105782 | 3/1983 | United Kingdom | 29/766 |
| 2165303 | 4/1986 | United Kingdom | 29/766 |

*Primary Examiner*—P. W. Echols

*Attorney, Agent, or Firm*—Herbert Dubno; Andrew Wilford

[57] ABSTRACT

A slide fastener is made from a workpiece formed of a pair of longitudinally extending parallel tapes having confronting edges provided with longitudinally extending and transversely couplable coupling elements. This workpiece is passed along a treatment path through a gapping station, a bottom-stop installing station, a slider-mounting station, a top-stop installing station, and a cutting station. The elements are removed from the tapes at gaps spaced longitudinally of the workpiece in the gapping station and a bottom stop is fitted to the elements at one end of each of the gaps in the bottom-stop installing station. A slider is mounted on the elements at the slider-mounting station between each gap and the following gap and a top stop is fitted to the elements in the top-stop installing station at each gap. Finally the tapes of the workpiece are transversely cut at the gaps at the cutting station into individual slide fasteners. The workpiece is marked upstream of the gapping station at locations spaced apart by predetermined distances and the work piece is stored in buffers downstream of each of the stations except the cutting station and only fed from each buffer into the immediately downstream station when a predetermined length of the workpiece is in the buffer. The marks on the workpiece are detected at each of the stations and the respective steps are triggered only when a one of the marks is detected.

14 Claims, 7 Drawing Sheets

MANUFACTURE OF SLIDE FASTENERS

FIELD OF THE INVENTION

The present invention relates to the manufacture of slide fasteners. More particularly this invention concerns a mass-production system for automatically producing such fasteners in large quantity.

BACKGROUND OF THE INVENTION

A slide fastener typically is formed by a pair of longitudinally extending and parallel textile tapes having confronting edges that carry interleavable coupling elements. These elements, which are typically made of a synthetic-resin coiled or meandered monofilament, do not extend the full length of the respective tapes and are joined together at their one ends by a so-called bottom end stop and each carry at their opposite ends a so-called top stop. A slide can move along both elements and is constructed such that on longitudinal movement from the bottom stop toward the top stops it interleaves, that is joins, the two coupling elements, and on opposite movement it separates them.

Such fasteners are typically made in a mass production operation in five different steps starting from a basic workpiece comprised of two very long parallel tapes whose confronting edges carry full-length coupling elements that are usually joined together In a first machine a gap is formed in the joined coupling elements, same being cut away or otherwise removed for short distances at locations spaced along the tapes by the length of the fasteners to be made. Then the bottom end stops are fitted to the joined coupling elements at what is normally relative to the direction of travel of the tapes the trailing edges of each gap. A slider is then fitted to the elements from the leading edge of each gap, being slid on in a direction tending to separate the elements. Subsequently the top stops are applied to the separated coupling elements immediately downstream of the slider at the leading end of each gap. Finally the tapes are cut transversely across generally through the center of the gap, separating out the individual fasteners.

These various machines, which may be supplemented by packing machines and the like, typically operate at widely different speeds. Some of the machines, for instance the gapper, inherently can only process a certain number of fasteners in a given amount of time while others can operate much more rapidly. In a standard setup two gapping machines feed a single machine for installing bottom stops, and same in turn feeds its output to several slider-installing units.

Thus the known fastener-manufacturing systems must have duplicates of some of the processing machines, so that when zipper size and/or style changes several machines doing the same process must be reprogrammed or adjusted. In general any change in the run requires that the production line be shut down a considerable amount of time.

In German patent document No. 3,172,401 filed Apr. 11, 1987 a solution to this problem was proposed in the form of a system which has only one machine for each step of the manufacture, and where the workpiece is fed serially through the succeeding machines. In order to compensate for the slowest machine, which in the case of this system is a welding machine at the upstream end of the line, storage units or buffers are provided between succeeding machines. In addition a counter is provided for each of the machines except the extreme downstream machine as well as a system to monitor how much of the workpiece is in the upstream buffer. Thus when an upstream machine has operated a predetermined number of cycles and has fed into the buffer hopper immediately downstream of itself a corresponding number of partially finished fasteners, the downstream machine is started and operates until the buffer is empty, whereupon it stops and waits until the immediately upstream machine has one again cycled the predetermined number of times.

Such an arrangement, while being some improvement on the system with parallel machines compensating for a slow machine, still is relatively unwieldy, and can only operate when the slowest of the machines is at the upstream end of the line. In addition this system is not easy to switch over from one size and/or style of fastener to another in that it requires that each and every machine be separately reset.

OBJECTS OF THE INVENTION

It is therefore an object of the present invention to provide an improved method of an apparatus for manufacturing slide fasteners.

Another object is the provision of such an improved method of and apparatus for manufacturing slide fasteners which overcomes the above-given disadvantages, that is which is fairly simple and which can be rapidly switched over from one size and/or style of fastener to another.

SUMMARY OF THE INVENTION

The instant invention is an improvement on a method of making slide fasteners wherein a workpiece formed of a pair of longitudinally extending parallel tapes having confronting edges provided with longitudinally extending and transversely couplable coupling elements is passed along a treatment path through a gapping station, a bottom-stop installing station, a slider-mounting station, a top-stop installing station, and a cutting station. The elements are removed from the tapes at gaps spaced longitudinally of the workpiece in the gapping station and a bottom stop is fitted to the elements at one end of each of the gaps in the bottom-stop installing station. A slider is mounted on the elements at the slider-mounting station between each gap and the following gap and a top stop is fitted to the elements in the top-stop installing station at each gap. Finally the tapes of the workpiece are transversely cut at the gaps at the cutting station into individual slide fasteners. According to this invention the workpiece is marked upstream of the gapping station at locations spaced apart by predetermined distances and the workpiece is stored in buffers downstream of each of the stations except the cutting station and only fed from each buffer into the immediately downstream station when a predetermined length of the workpiece is in the buffer. The marks on the workpiece are detected at each of the stations and the respective steps are triggered only when a one of the marks is detected.

Thus with the system of the this invention the main change between successive runs of slide fasteners, that is the length, need only be reset on the marking machine. The downstream machines will automatically function in accordance with the applied marks. Thus changeover from one length fastener to another is a very simple matter. The marks themselves can delimit unusable portions of the workpiece, for instance the region where two different workpieces are spliced together. Thus the system can also serve to mark off unusable portions of the workpiece so that they can be discarded and stops and sliders are not wasted on them. The instant invention can be carried out simply with standard control techniques so that the machine operator can readily distinguish between a standard waiting condition for one of the machines and an error condition whereby one of the machines needs his or her attention.

According to this invention the workpiece is marked by forming holes in it. In addition the gaps are also detected to trigger the respective steps. Normally the marks are detected optically.

In accordance with a further feature of this invention the number of times each of the gapping and stop- and slider-installing is performed is counted and each of the following steps is only performed when the respective preceding steps has been done a respective predetermined number of times. This is substantially the system described in the above-cited German patent document.

Furthermore according to this invention a new workpiece is spliced to the workpiece at a trailing end thereof and the region of the splice is marked as an unusable workpiece part. In addition the individual fasteners are at the end of the production line stacked and bundled in a separate apparatus, a speedup conveyor being used to make up for the difference between the operation of this device, which typically makes up one bundle while it transports away the other, and that of the upstream cutter.

DESCRIPTION OF THE DRAWING

The above and other objects, features, and advantages will become more readily apparent from the following, reference being made to the accompanying drawing in which.

SPECIFIC DESCRIPTION

Figure 1:
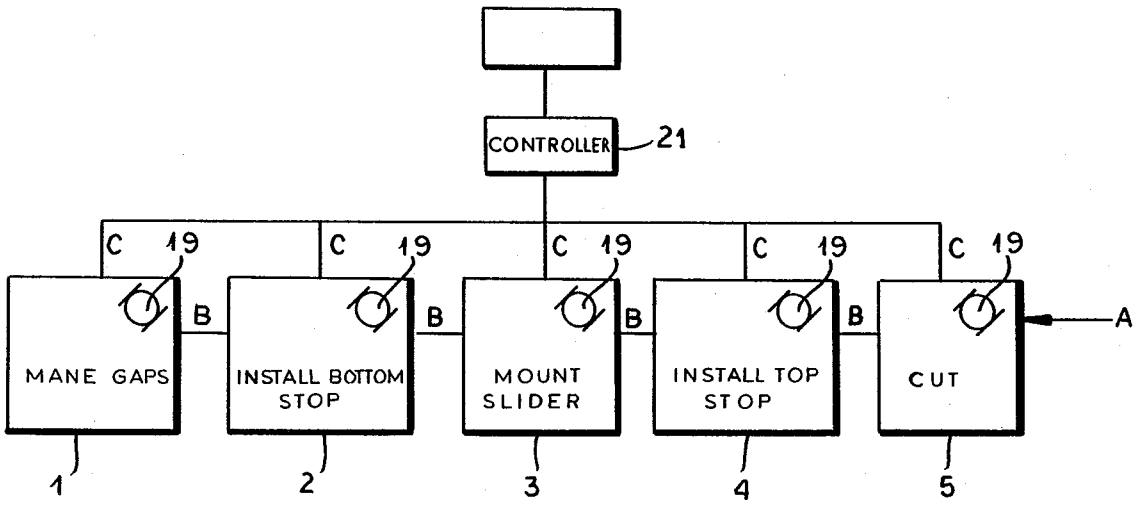
FIG. 1 is a block diagram illustrating the method of the instant invention.

As seen in FIGS. 1 and 8 a slide fastener is made basically in five stages. First a basic workpiece RK comprised of two tapes 15 whose confronting edges have interleaved coupling elements 16 is formed in an apparatus 1 with successive gaps 10 that are formed by cutting out short sections of the elements 16 at longitudinal spacings equal to the length of the fastener to be made. Then in a second apparatus 2 a bottom stop 17 (FIG. 8*a*) is mounted at the trailing end of each gap 10 on the two elements 16, fastening them and the tapes 15 together at this location. Then (FIG. 8*b*) in a machine 3 a slider 18 is fitted from the upstream end of each gap 10 onto the two coupling elements 16 and a machine 4 puts a top stop at the trailing end of each element 16, leaving the slider 18 captured and this slider 18 is pushed to the top end (FIG. 8*c*). Finally (FIG. 8*d*) a machine 4 cuts the tapes 15 across at the center of each gap 10, leaving a finished fastener RV. Then as indicated in FIGS. 8*e* and 8*f* the fasteners RV are stacked and then bound together with a tape 21 in a machine 14.

Figure 2:
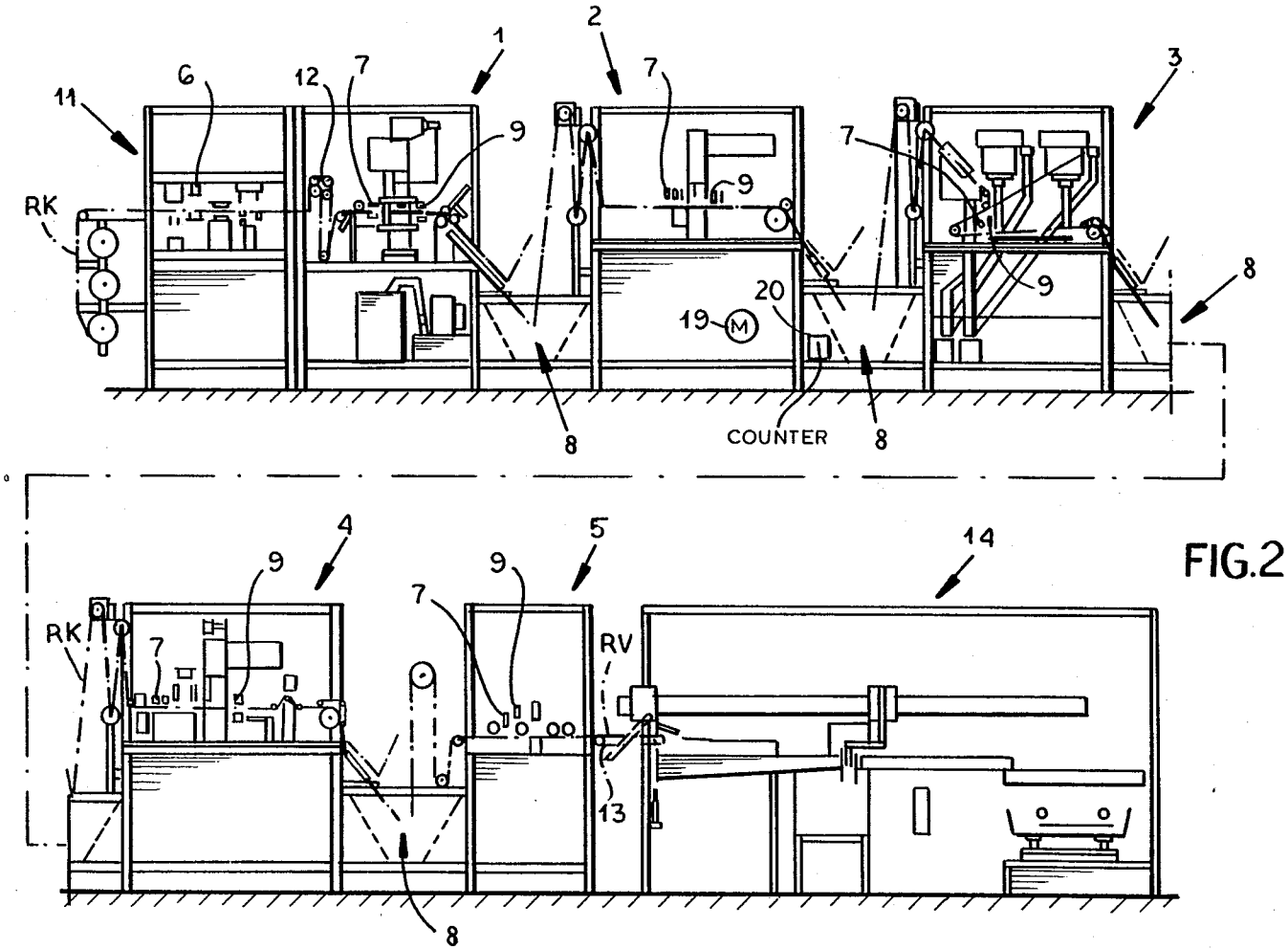
FIG. 2 is a small-scale partly diagrammatic side view illustrating the system according to this invention.

According to this invention and as shown in FIG. 2 each of the machines 1, 2, 3, 4, and 5 has its own drive 19 and downstream of each of the machines 1, 2, 3, and 4 is a buffer 8. A counter 20 is provided that keeps track of the operating cycles of each of the machines 1, 2, 3, and 4. The buffer 8 and counter 20 operate as described in the above-cited German patent document. No such buffer is provided between the machines 5 and 14; instead a two-level speedup conveyor 13 is used. In addition at the extreme upstream end of the line formed by the machines 1 through 5 is a device 6 that forms on the tapes marks S that can be simple indicia applied but that here are holes burnt right through the tapes 15.

Each of the machines 1, 2, 3, 4, and 5 is provided with an optical sensor 9 that can detect these markings S and that serves to trigger operation of the respective drives 19. In addition each machine 2, 3, 4, and 5 is coupled to the upstream counter 20 so that it only can operate when the respective counter 20 has determined that the respective upstream machine 1, 2, 3, or 4 has operated a certain number of times. Thus each machine 1, 2, 3, 4, and 5 will only do its job when it detects one of the marks S and the machines 2, 3, 4, and 5 will also be impeded from doing their jobs unless also at the same time the respective upstream counter 20 has determined that the immediately upstream machine has functioned a certain number of cycles, that is that the respective buffer 8 is holding a certain amount of the workpieces. These buffers 8 have arms 22 that are moved when the supply in them is depleted, that is when the strip being worked gets taut, and whose actuation shuts off the piece of equipment immediately downstream.

Figure 3:
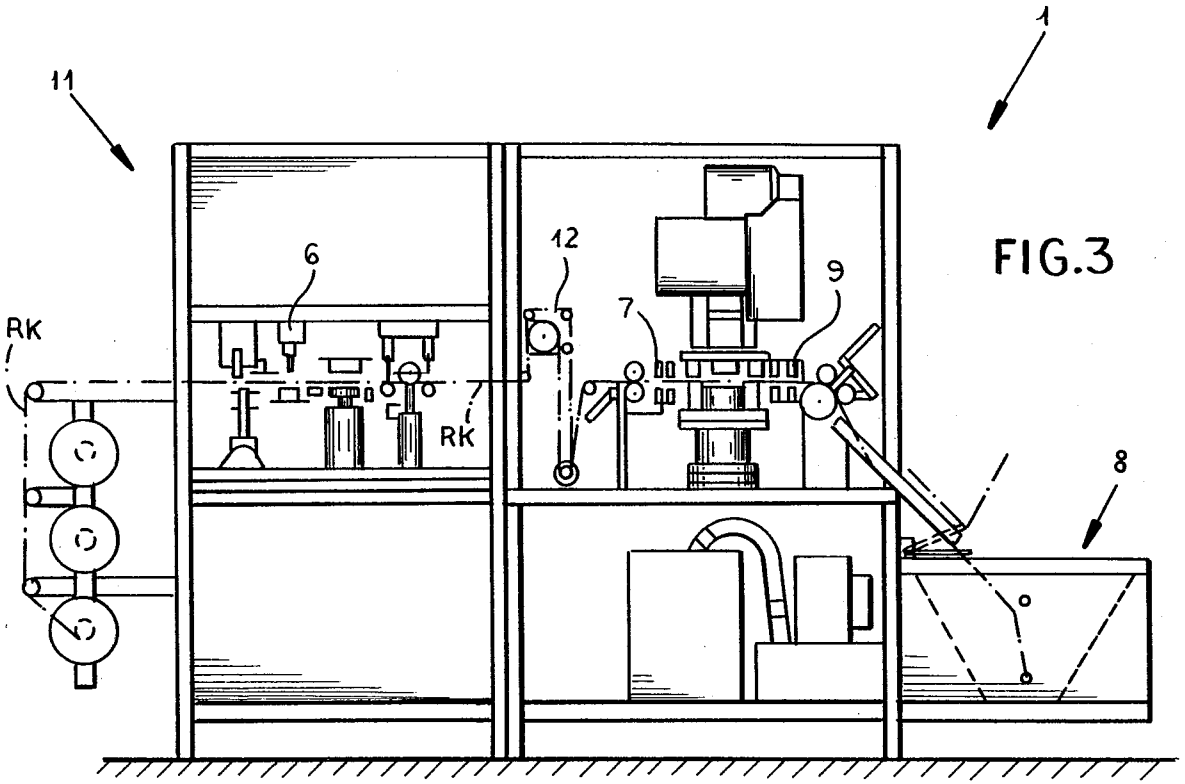
FIG. 3 is a larger-scale side view of the input end of the system of this invention.
Figure 4:
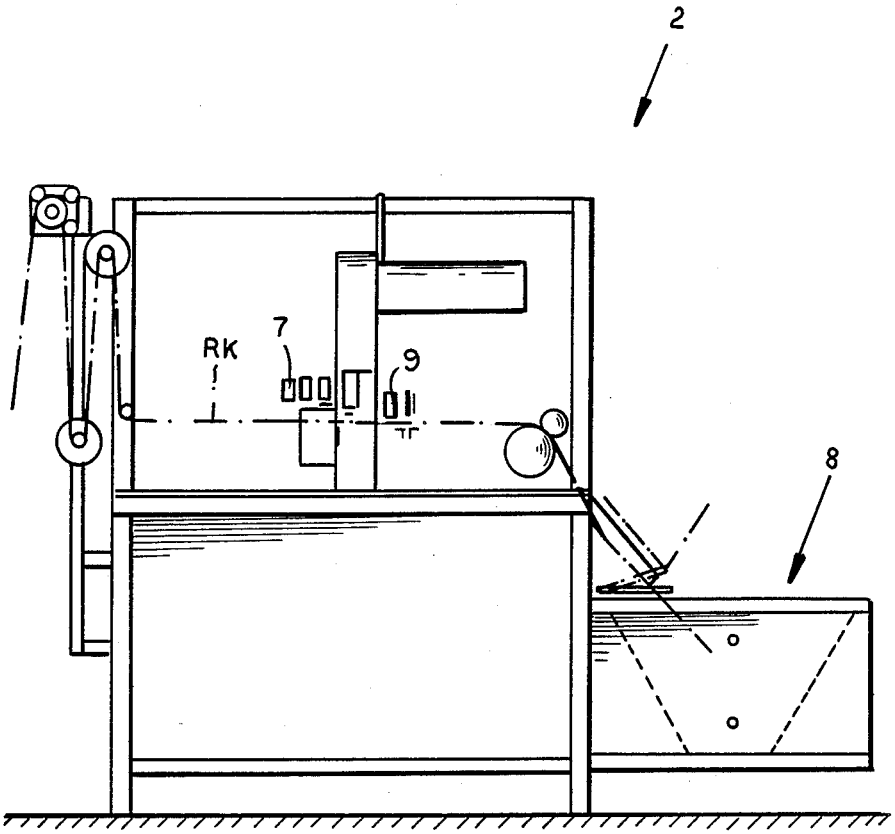
FIGS. 4, 5, and 6 are larger-scale side views of the machines for installing the bottom stops, mounting the sliders, and installing the top stops, respectively.
Figure 5:
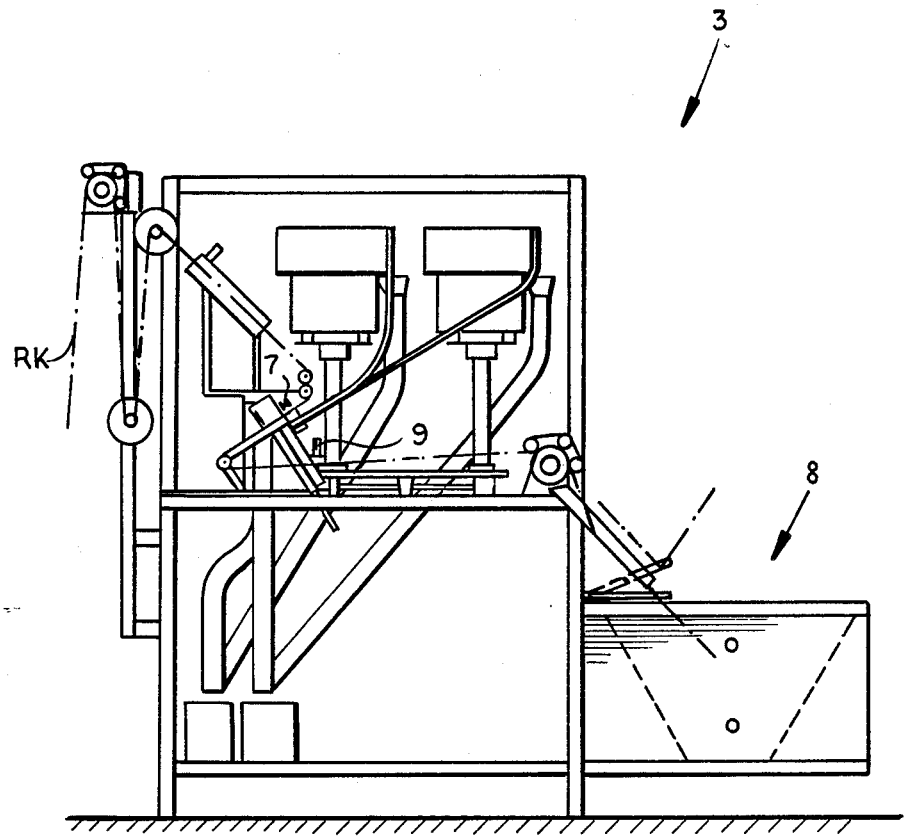
Figure 6:
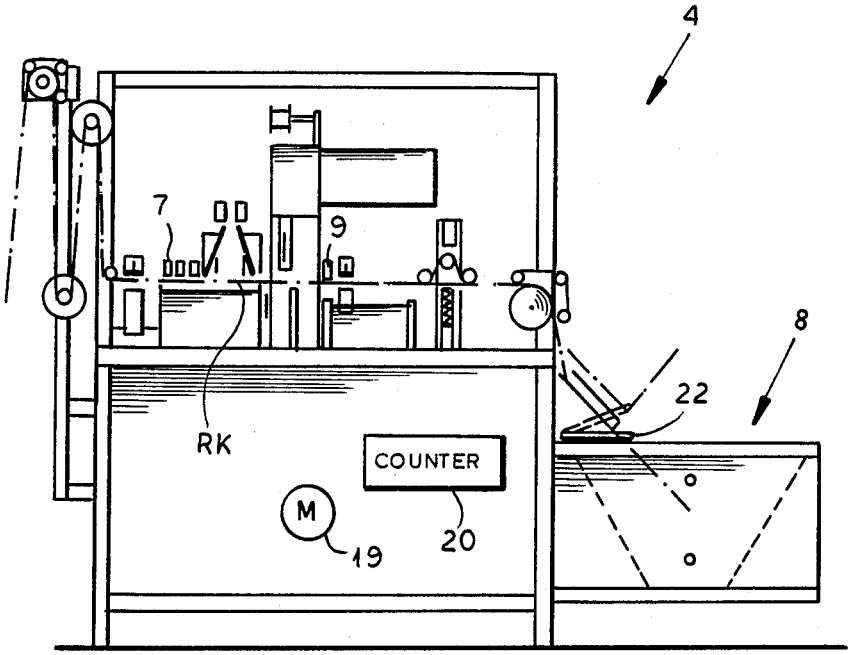
Figure 7:
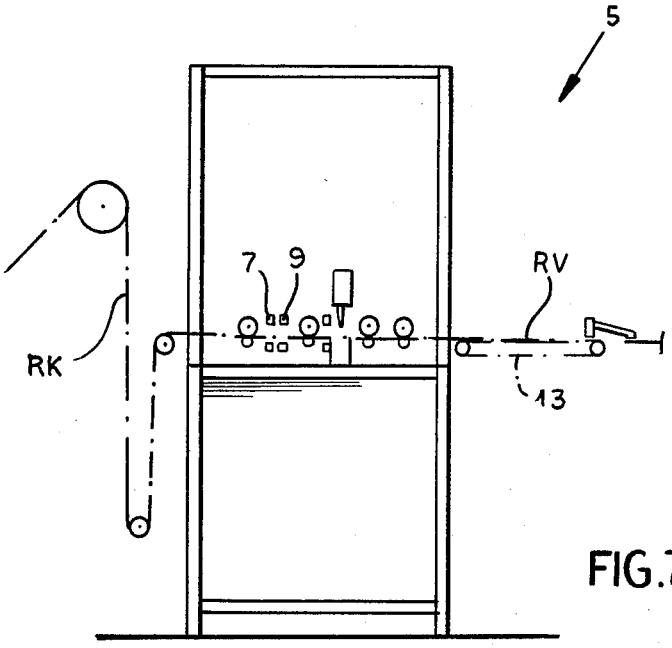
FIG. 7 is a larger-scale side view of the output end of the system of this invention.
Figure 8A:
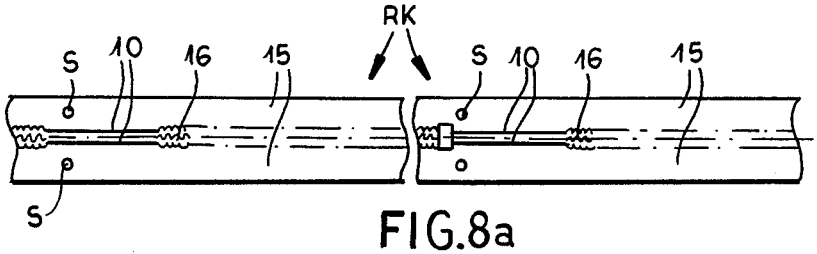
FIGS. 8*a* through 8*f* are top views illustrating the slide-fastener as it is being manufactured according to the present invention in successive stages of manufacture.
Figure 8B:
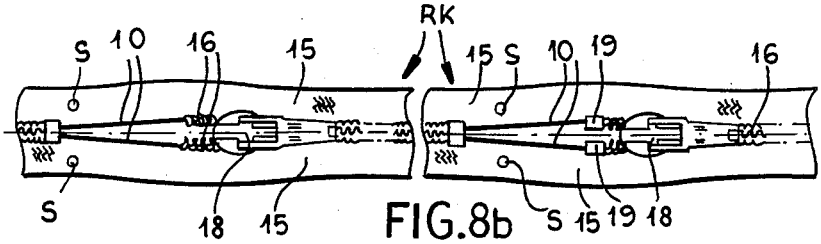
Figure 8C:
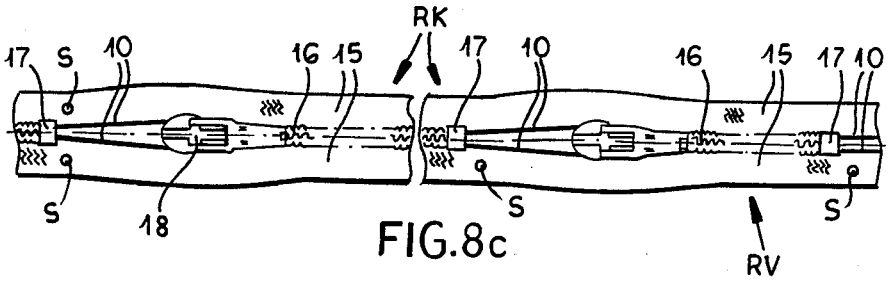
Figure 8D:
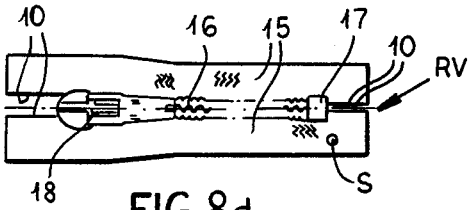
Figure 8E:
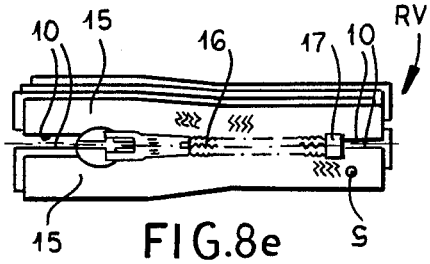
Figure 8F:
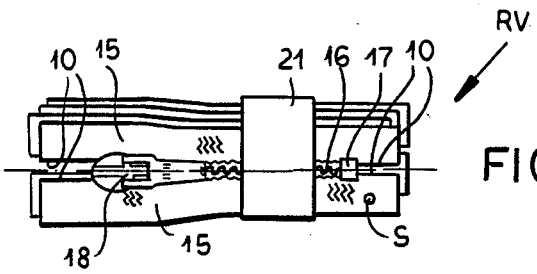

In addition this system is provided downstream of the marker 6 and upstream of the gapper 1 as seen in FIG. 3 with a splicing unit 11 that can attach a new workpiece RK to the trailing end of an existing workpiece RK when style, size, and/or color need to be changed. A looper 12 is provided so that the intermittent operation of the two pieces of equipment 1 and 11 can be matched.

The entire system is operated by a controller 21 that normally need only be connected to the splicer 11, gapper 1, and packing machine 14, the other machines 2, 3, 4, and 5 all operating independently as the workpiece is fed through them. This clearly makes the system very simple to set up for a fastener of different style and/or dimension. The system therefore operates at a first level A with its own drives 19, each machine is connected at a second level B with the immediately upstream and/or downstream machines, and at a level C to the controller 21, although this level C need not as mentioned above extend to the machines 2, 3, 4, and 5.

The optical sensors 9 can also be set up to recognize the gaps 10 as marking indicia. In addition it is within the scope of this invention to use the marker 6 to identify damaged or unusable portions of the workpiece tape RK and mark the tape RK accordingly, so that the marked-off portion is not provided with stops and slider.

We claim:

1. In a method of making slide fasteners comprising the steps of:

(a) sequentially passing a workpiece formed of a pair of longitudinally extending parallel tapes having confronting edges provided with longitudinally extending and transversely couplable coupling elements along a treatment path through a gapping station, a bottom-stop installing station, a slider-mounting station, a top-stop installing station, and a cutting station;

(b) removing the elements from the tapes at gaps spaced longitudinally of the workpiece in the gapping station;

(c) fitting a bottom stop to the elements at one end of each of the gaps in the bottom-stop installing station;

(d) mounting a slider to the elements at the slider-mounting station between each gap and the following gap;

(e) fitting top stops to the elements in the top-stop installing station at each gap; and (f) transversely cutting the tapes of the workpiece at the gaps at the cutting station into individual slide fasteners, the improvement comprising the steps of:

marking the workpiece upstream of the gapping station at locations spaced apart by predetermined distances;

storing the workpiece in buffers downstream of each of the stations except the cutting station and only feeding the workpiece from each buffer into the immediately downstream station when a predetermined length of the workpiece is in the buffer; and detecting the marks on the workpiece at each of the stations and triggering the respective steps only when a one of the marks is detected.

2. The method defined in claim 1 wherein the workpiece is marked by forming holes in it.

3. The method defined in claim 1 wherein the gaps are also detected to trigger the respective steps.

4. The method defined in claim 1 wherein the marks are detected optically.

5. The method defined in claim 1, further comprising the step of:

counting the number of times each of steps (b), (c), (d), and (e) is done and only doing each of the following steps when the respective preceding step has been done a respective predetermined number of times.

6. The method defined in claim 1, further comprising the step of:

splicing a new workpiece to the workpiece at a trailing end thereof and marking the region of the splice as an unusable workpiece part.

7. The method defined in claim 1, further comprising the step of:

(g) stacking and bundling the individual fasteners.

8. A system for making slide fasteners from a workpiece formed of a pair of longitudinally extending parallel tapes having confronting edges provided with longitudinally extending and transversely couplable coupling elements, the apparatus comprising:

means for marking the workpiece upstream of the gapping station at locations spaced apart by predetermined distances;

means forming a treatment path through a gapping station, a bottom-stop installing station, a slider-mounting station, a top-stop installing station, and a cutting station;

means for removing the elements from the tapes at gaps spaced longitudinally of the workpiece in the gapping station;

means for fitting a bottom stop to the elements at one end of each of the gaps in the bottom-stop installing station;

means for mounting a slider to the elements at the slider-mounting station between each gap and the following gap;

means for fitting top stops to the element in the top-stop installing station at each gap; and means for transversely cutting the tapes of the workpiece at the gaps at the cutting station into individual slide fasteners, buffer means for storing the workpiece in buffers downstream of each of the stations except the cutting station and only feeding the workpiece from each buffer into the immediately downstream station when a predetermined length of the workpiece is in the buffer; and means for detecting the marks on the workpiece at each of the stations and triggering the respective means only when a one of the marks is detected.

9. The system defined in claim 8 wherein the marking means forms holes in the workpiece.

10. The system defined in claim 8 wherein the detecting means also detects the gaps.

11. The system defined in claim 8 wherein detecting means functions optically.

12. The system defined in claim 8, further comprising means for counting the number of times each of removing, mounting, and installing means operates and only doing each of the following operations when the respective preceding step has been done a respective predetermined number of times.

13. The system defined in claim 8, further comprising means for splicing a new workpiece to the workpiece at a trailing end thereof and marking the region of the splice as an unusable workpiece part.

14. The system defined in claim 8, further comprising means for stacking and bundling the individual fasteners.

* * * * *